United States Patent [19]

Wodnicki

[11] Patent Number: 4,585,147

[45] Date of Patent: Apr. 29, 1986

[54] DISPENSER FOR COLLAPSIBLE TUBE CONTENTS

[76] Inventor: Tomasz J. Wodnicki, 6805 Veterans Blvd., Metairie, La. 70003

[21] Appl. No.: 602,902

[22] Filed: Apr. 23, 1984

[51] Int. Cl.[4] ..... B67D 5/22; B65D 35/28

[52] U.S. Cl. ..... 222/50; 222/103; 74/89.15

[58] Field of Search ..... 222/95, 102, 103, 101, 222/50; 74/89.15

[56] References Cited

U.S. PATENT DOCUMENTS

| | | | |
|---|---|---|---|
| 1,763,273 | 6/1930 | Strauss et al. | 222/102 |
| 2,140,007 | 12/1938 | Grandman | 222/102 |
| 2,492,533 | 12/1949 | Olsen | 222/103 |
| 3,187,951 | 6/1965 | Hardman et al. | 222/102 |
| 3,297,205 | 1/1967 | Sumner | 222/102 |
| 4,140,117 | 2/1979 | Buckles et al. | 222/50 |

*Primary Examiner*—Joseph J. Rolla

*Assistant Examiner*—Andrew Jones

*Attorney, Agent, or Firm*—Keaty & Keaty

[57] ABSTRACT

An improved dispenser for the contents of collapsible tubes is provided in which a pair of opposing squeezers are advanced along two opposing pairs of externally threaded rods within a housing. The squeezers are made of a flexible material such as semi-rigid rubber and are configured such that one end of each squeezer is longitudinally displaced towards the dispensing aperture in the housing and transversely displaced towards the sidewall of the housing. This arrangement causes the squeezers to deform and change profile when the leading edges of the advancing squeezers are stopped prior to the following edges being stopped. The deformation of the squeezers more effectively places pressure on the collapsible tube near the dispensing aperture of the tube and substantially completely dispenses the contents of the tube.

10 Claims, 8 Drawing Figures

DISPENSER FOR COLLAPSIBLE TUBE CONTENTS

BACKGROUND OF THE INVENTION

1. Field of the Invention

This invention concerns dispensers for the contents of collapsible tubes. This dispenser is of the type which substantially completely empties the contents of a tube by advancing a pair of cooperating, flexible squeezers along the tube longitudinally.

2. Discussion of the Prior Art

Collapsible tubes of the type which are used to dispense toothpaste have long been known in the art. These tubes are usually made of an aluminum-like material which is puncture resistant yet malleable so that the tube can be compressed to increase the internal pressure of the tube and propel the contents thereof through an opening at one end of the tube.

Since the advent of the collapsible tube, a method for efficiently and substantially completely dispensing the contents of the tube has been sought. The search for such a method has been necessitated by the fact that when the tube is compressed manually, the fingers depress the tube at discrete areas, leaving pockets of uncompressed tube therebetween.

One attempted solution to this problem was the provision of a metal clip which is placed transverse to the elongated tube with one leg of the clip being on each side of the tube. The clip is provided with a perpendicular handle which can be rotated to wind the clip around an axis perpendicular to the longitudinal axis of the tube. In this fashion the tube is wound into a tight cylindrical configuration to evenly dispense the contents of the tube. This process is seriously flawed, however, in that the contents of the tube adjacent the tube dispensing aperture at one end cannot be effectively dispensed because the key clip is prevented from advancing by the collar of the tube adjacent the dispensing aperture. This process also results in an unsightly, partially wound tube which detracts from the appearance of a bathroom, or other room, in which it is placed.

SUMMARY OF THE INVENTION

It is accordingly an object of this invention to provide a dispenser for the contents of collapsible tubes which effectively dispenses substantially all the contents of the tube.

It is also an object of this invention to provide an aesthetically appealing dispenser.

An additional object of the invention is to provide a means for indicating how much of the contents of the tube have been dispensed without making it necessary to open the dispenser and directly visually inspect the partially collapsed tube.

The present invention has achieved these objects and overcome the drawbacks of the prior arts by providing a dispenser for the contents of collapsible tubes having an elongated housing with an internal cavity configured to receive the collapsible tube therewithin. A dispensing aperture is provided at one end of the housing which can be aligned with the dispensing aperture of the collapsible tube which is placed within the housing. Two pairs of opposing, parallel, externally threaded rods are rotatably mounted longitudinally within the housing. These rods can be rotated through an external knob which is connected to a gear drive train for rotating the rods in a uniform direction at the same speed. A pair of opposing, cooperating, flexible squeezers are mounted on drive shafts, each shaft being connected between a pair of rods. The shafts are connected to the rods with internally threaded nuts which are disposed in rotating engagement around each of the rods. Rotation of the knob and transmission of this rotational movement through the gear train to the rods advances the squeezers longitudinally along the tube to dispense the contents thereof. Each of the squeezers is configured to present a pair of opposing squeezing faces that leave only enough room for the emptied tube to pass through. Each of the squeezers is provided with an extension that is offset longitudinally towards the dispensing aperture and transversely towards a wall of the housing. Accordingly, the portion of the flexible squeezer that is displaced towards the wall of the housing reaches the end of the internal, tube receiving cavity of the housing before the other end of the squeezer reaches that same termination point. This results in a deformation of the flexible squeezers that changes the profile of the squeezers to more effectively dispense the contents of the tube.

DETAILED DESCRIPTION OF THE PREFERRED EMBODIMENT

Figure 1:
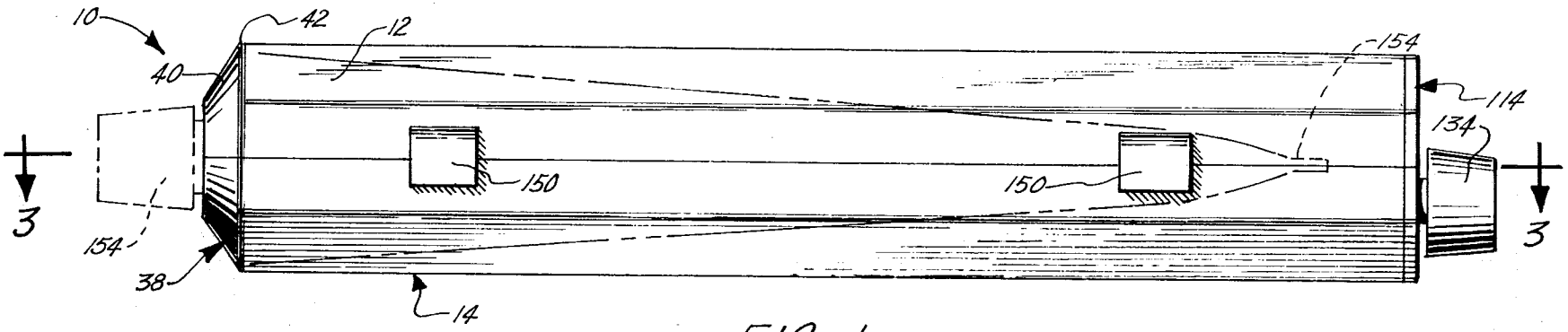
FIG. 1 is a side view of the housing of the instant invention, the outline of a collapsible tube and its cap being shown in phantom.

Referring now to the drawings, a dispenser 10 for the contents of a collapsible tube 12 is shown. The dispenser 10 is comprised of an elongated, plastic housing 14 having an internal cavity 16 configured to receive collapsible tube 12 therewithin (see FIG. 5). Housing 14 is comprised of first and second opposing, complementary, substantially mirror image shells 18, 20 (see FIG. 8) joined along a longitudinal hinge 22 about which shells 18, 20 may be rotated to selectively pivot shells 18, 20 away from each other and open housing 14. The internal cavity of each shell, which comprises about one-half of the cavity 16, is generally trapezoidal in cross-section, the first parallel base 24, 26 of the trapezoid in each shell 18, 20 presenting an opening to cooperatively form the tube receiving cavity 16 (see FIG. 8) the second parallel base of the trapezoid in each shell 18, 20 being closed to form a longitudinal wall 32, 34 of shell 18, 20. Housing 14 is provided with a dispensing aperture 36 at a first end 38 of housing 14. Aperture 36 is surrounded by annular collar 40 which defines aperture 36 and mates along seam 42 with housing 14.

A first pair of parallel, externally threaded rods 44, 46 are mounted longitudinally within first shell 18 adjacent first base 24 of cavity 16. Placement of these rods can be better understood by reference to the fact that an imaginary plane through the first pair of rods would be substantially parallel to base 24. A second pair of parallel, externally threaded rods 48, 50 are rotatably mounted longitudinally within the second shell 20 adjacent first base 26. Rod 48 is placed in opposing, parallel relationship to rod 44 and rod 50 is placed in opposing, parallel relationship to rod 46 such that an imaginary plane through rods 48, 50 would be substantially parallel to the imaginary plane through rods 44, 46.

Figure 3:
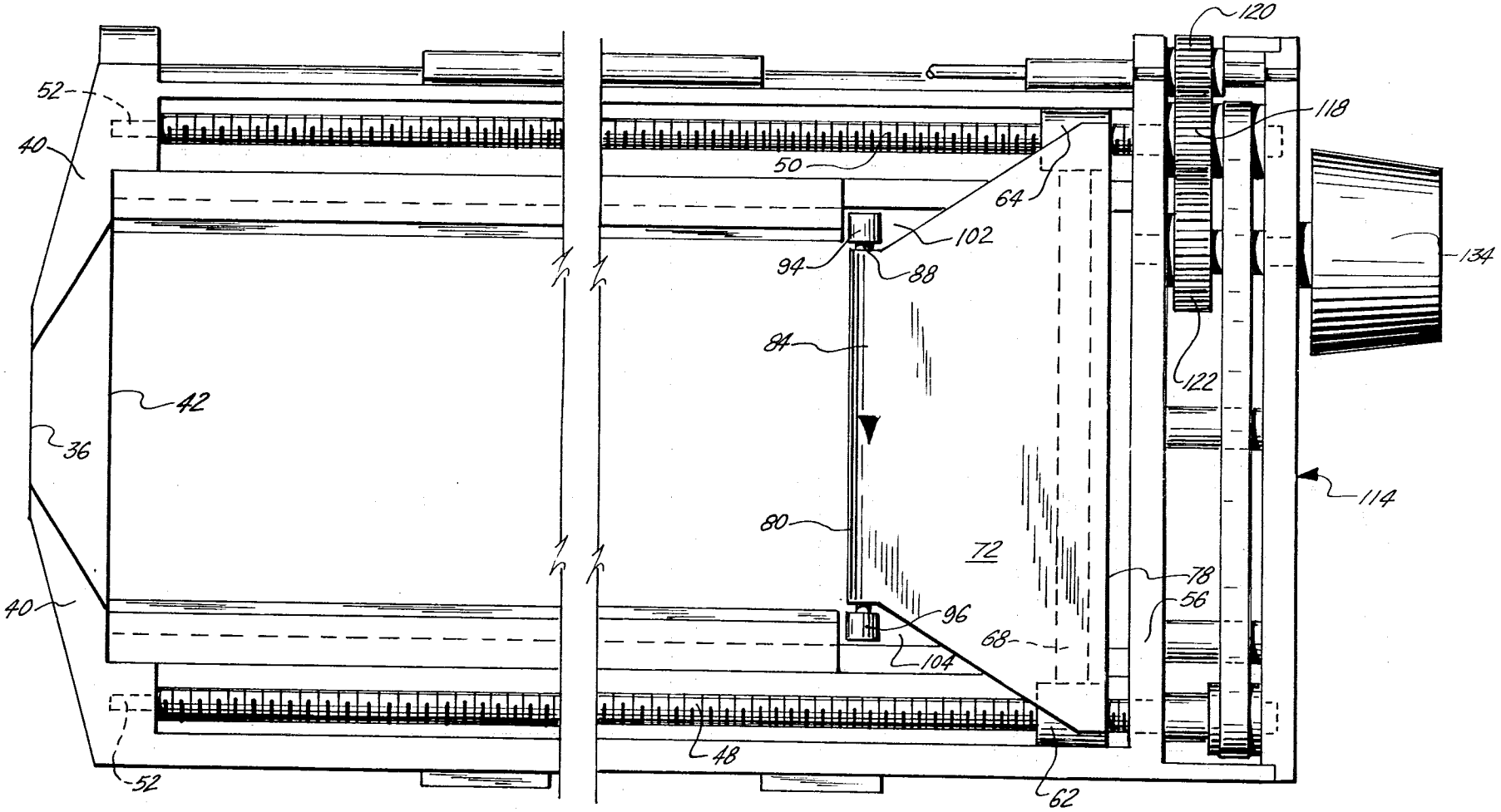
FIG. 3 is an enlarged, fragmentary, cross-sectional view taken along section lines 3—3 of FIG. 1.
Figure 4:
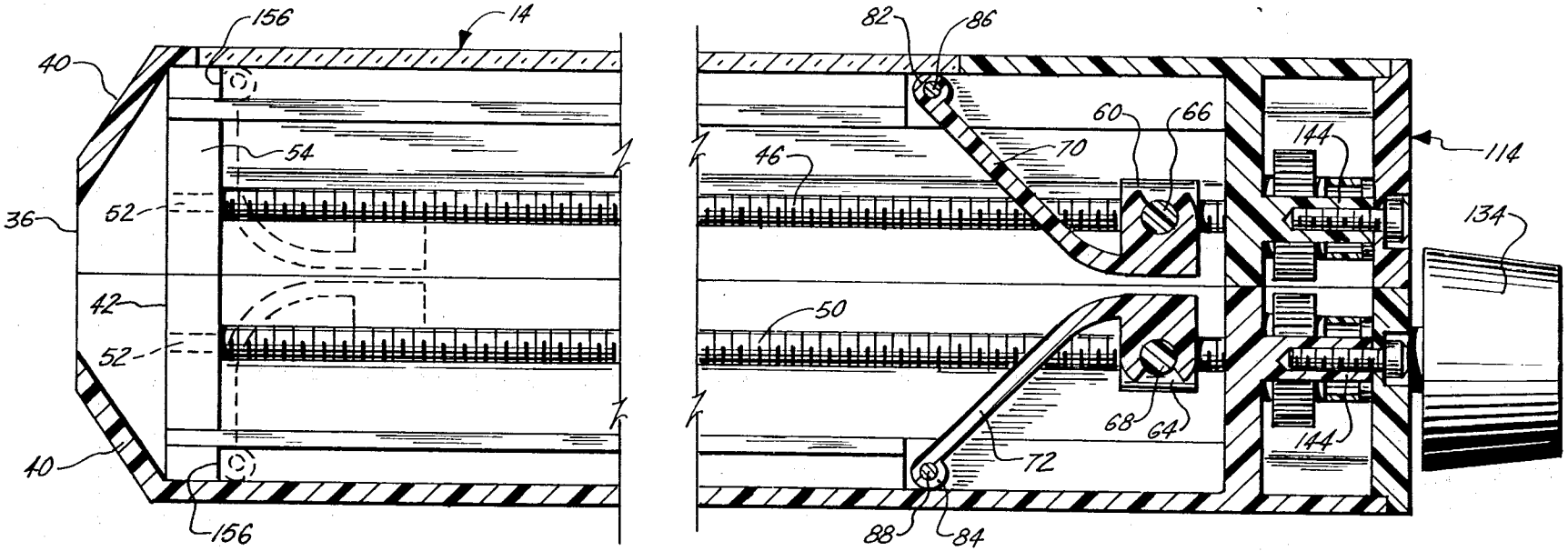
FIG. 4 is an enlarged, fragmentary, cross-sectional view taken along section lines 4—4 in FIG. 2.

Rods 44, 46, 48 and 50 are rotatably mounted within housing 14 by means of spindles 52 placed in spindle receiving apertures through member 54 transversely disposed across cavity 16 adjacent end 38 of housing 14 (see FIG. 4). The opposite end of rods 44, 46, 48 and 50 are rotatably engaged within bearing housing 56 (FIG. 3).

Internally threaded nuts 58, 60, 62, 64 (see especially FIGS. 3 & 5) is mounted in rotatable engagement on each of said rods 44, 46, 48 and 50 respectively. A first driving shaft 66 is mounted between nuts 58, 60 and a second driving shaft 68 is mounted between nuts 62, 64.

First and second generally trapezoidally shaped flexible squeezers 70, 72 are made of a flexible material such as semi-rigid rubber. Flexible squeezer 70 has a first base 74 and second base 76, which bases are substantially parallel to each other. Squeezer 72 has first base 78 and second base 80, which bases are substantially parallel to each other. The first base 74, of first squeezer 70 is mounted on first shaft 66, the first base 78 of second squeezer 72 being mounted on second driving shaft 68, the distance between first and second bases 74, 78 of squeezers 70, 72 being sufficient to provide a clearance through which only a substantially emptied tube may pass, the second base 76 of first squeezer 70 being longitudinally displaced in housing 14 towards dispensing aperture 36 and transversely displaced towards longitudinal wall 32 of first shell 18. Second squeezer 72 is longitudinally displaced in housing 14 towards aperture 36 and transversely displaced toward longitudinal wall 34 of second shell 20, the second base of each squeezer 70, 72 being configured into a circumscribing portion 82, 84 to circumscribe roller pins 86, 88 respectively. A cylindrical roller 90, 92 is provided at each terminus of pin 86 and rollers 94, 96 are provided at each terminus of pin 88. Rollers 90, 92 are in rolling engagement with wall 32 and rollers 94, 96 are in rolling engagement with wall 34.

Wall 32 is provided with opposing, substantially parallel and at least partially roller enclosing grooves 98, 100. Wall 34 is similarly provided with opposing, substantially parallel and at least partially roller enclosing grooves 102, 104. (See FIG. 5). Grooves 98, 100, 102, 104 are longitudinally disposed within the longitudinal wall towards which the roller is transversely displaced, and grooves 98, 100, 102, 104 provide means for guiding longitudinal movement of squeezers 70, 72.

Figure 8:
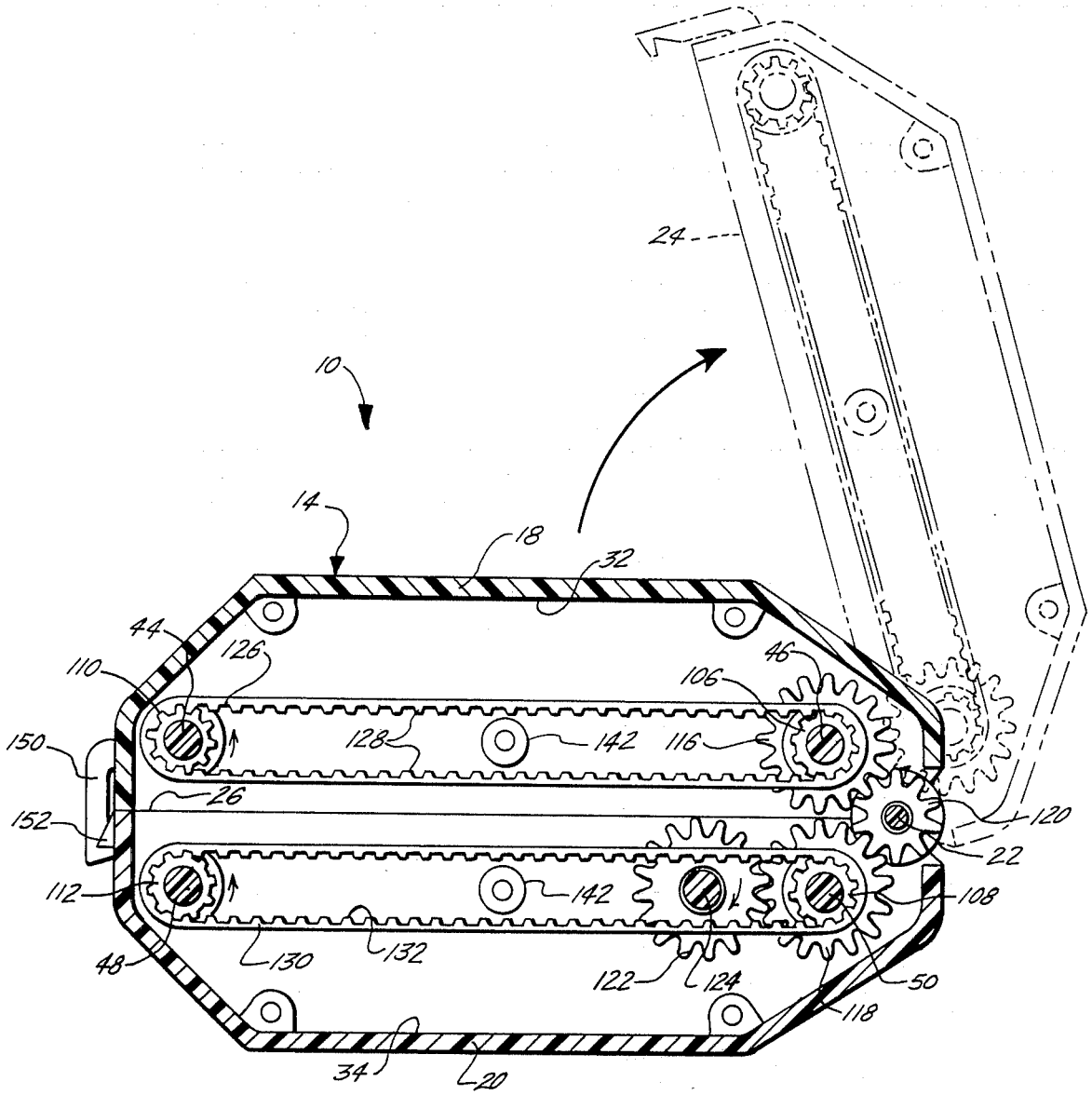
FIG. 8 is an enlarged, cross-sectional view taken along section lines 8—8 in FIG. 2, the phantom lines showing the relative position of the shells of the housing after the shells are rotated apart from each other so that the collapsible tube can be placed in or taken out of the housing.

Referring now to FIG. 8, it can be seen that a sprocket wheel 106 is affixed concentrically around rod 46, and sprocket 108 is affixed concentrically around rod 50; sprocket wheel 110 is affixed around rod 44 while sprocket wheel 112 is affixed concentrically around rod 48. All of sprocket wheels 106, 108, 110, 112 are affixed to the rods adjacent second end 114 of housing 14 and are in substantially the same transverse plane through housing 14.

A gear wheel 116 is concentrically mounted around rod 46 on the side of sprocket 106 more adjacent first end 38. Gear wheel 118 is concentrically mounted on rod 50 on the side of sprocket 108 more adjacent end 38. Gear wheels 116, 118 can also be referred to as those gear wheels adjacent longitudinal hinge 22.

A pinion wheel 120 is mounted concentrically on hinge 22 and in mesh with both of gear wheels 116, 118 for transmitting rotational movement from gear wheel 116 to gear wheel 118 or from gear wheel 118 to gear wheel 116.

A drive wheel 122 (see FIG. 8) is rotatably mounted in mesh with gear wheel 118. Drive wheel 122 is provided with a drive axle 124 which projects through end 114 of housing 14 to retain drive wheel 122 in rotating engagement with end 114 of housing 14.

A first synchronous continuous belt 126 having internal teeth 128 for positively engaging sprocket wheels 106, 110 is provided. A second synchronous continuous belt 130 having internal teeth 132 is provided for positively engaging said sprocket wheels 108, 112 on the pair of threaded rods designated 48, 50.

Turning once again to FIGS. 1 and 2, a knob 134 is affixed to the portion of drive axle 124 that projects outside of end 114 of housing 14. Knob 134 is provided for turning drive wheel 122 to impart rotational motion in a first direction to gear wheel 118 with which it is in mesh, the rotational motion being transmitted to the other gear wheel 116 through pinion wheel 120, both of gear wheels 116, 118 thereby rotating in the same direction, the rotational motion of the gear wheels being transmitted through the rotation of the threaded rods 46, 50 to which they are attached to the sprocket wheel 106, 108 on said rods adjacent hinge 22. The rotational movement of sprocket wheels 106, 108 adjacent hinge 22 is transmitted to the sprocket wheels 110, 112 which are not adjacent hinge 22 through first synchronous belt 126 and second synchronous belt 130. The movement of sprocket wheels 110, 112 which are not adjacent hinge 22 is imparted to threaded rods 44, 48 to which they are affixed, thereby resulting in uniform rotational movement of rods 44, 46, 48, 50 to longitudinally move nuts 58, 60, 62, 64 along rods 44, 46, 48, 50 to advance and retract squeezers 70, 72.

Figure 2:
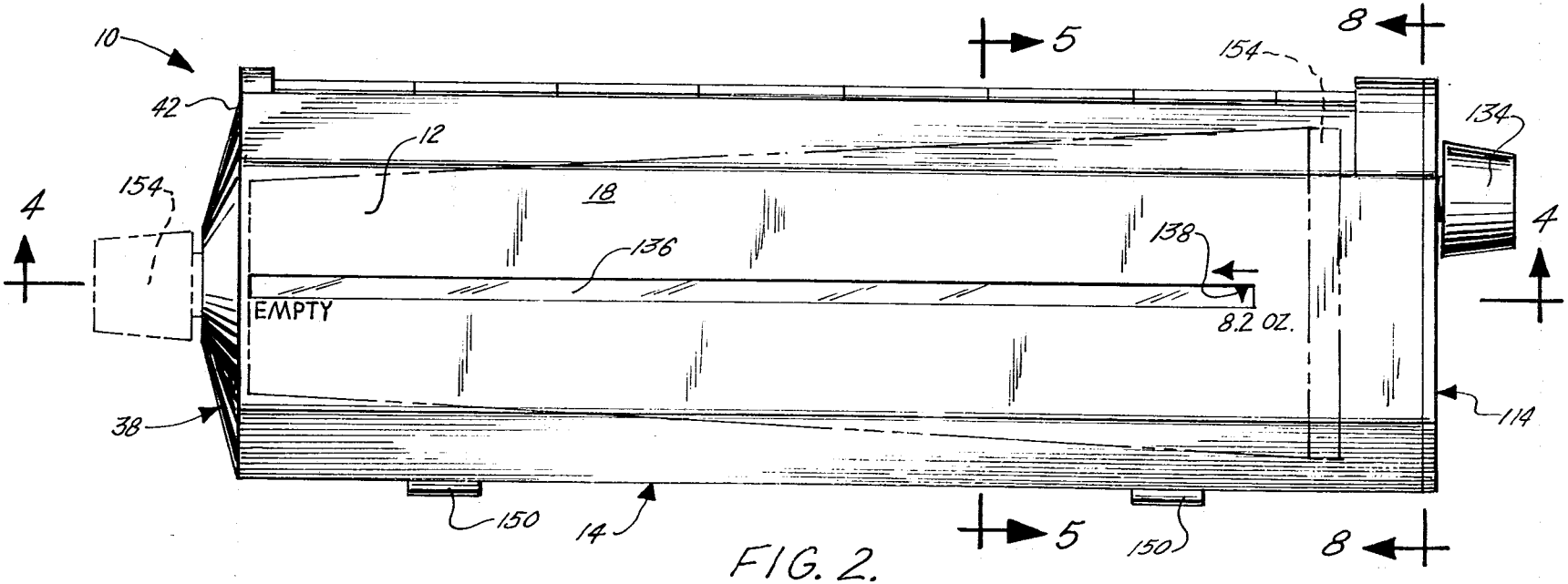
FIG. 2 is a top view of the housing shown in FIG. 1.
Figure 5:
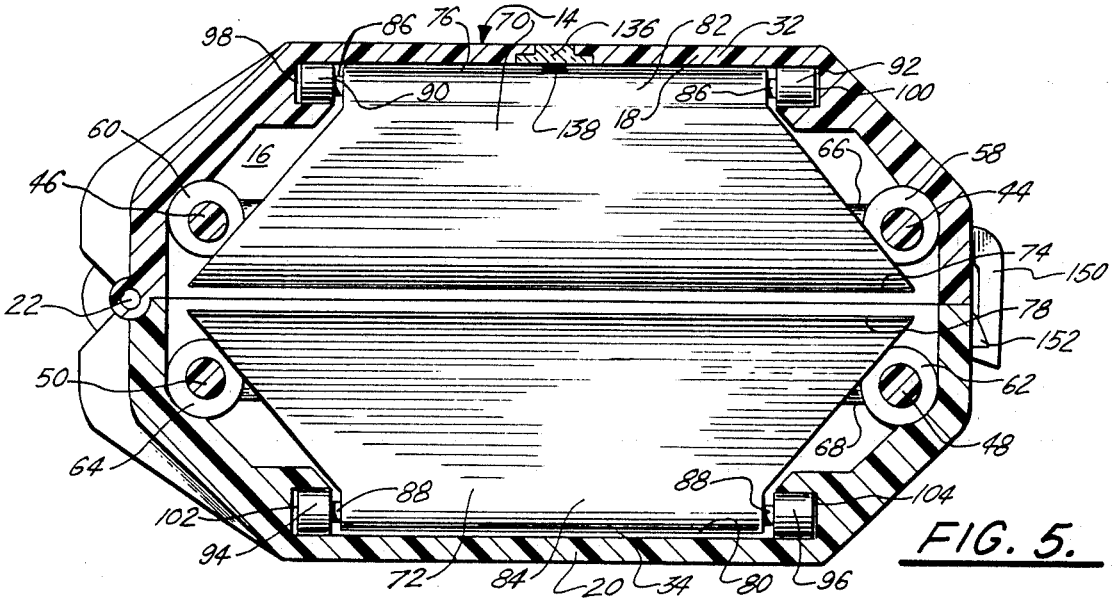
FIG. 5 is an enlarged, cross-sectional view taken along section lines 5—5 in FIG. 2.

As shown in FIGS. 2 and 5, a window slot 136 is longitudinally disposed along housing 14 through longitudinal wall 32 of shell 18. An indicator mark 138 on squeezer 70 adjacent window 136 can be viewed through window 136. Mark 138 moves as squeezer 70 is advanced to indicate the degree to which the contents of tube 12 have been dispensed.

Second end 114 of housing 14 is provided with a plurality of apertures through which screws 140, 142 are placed in order to threadably engage end 114 to housing 14 of dispenser 10. Screws 140, 142 are affixed to portions of the internal housing, such as housing portions 144.

Figure 6:
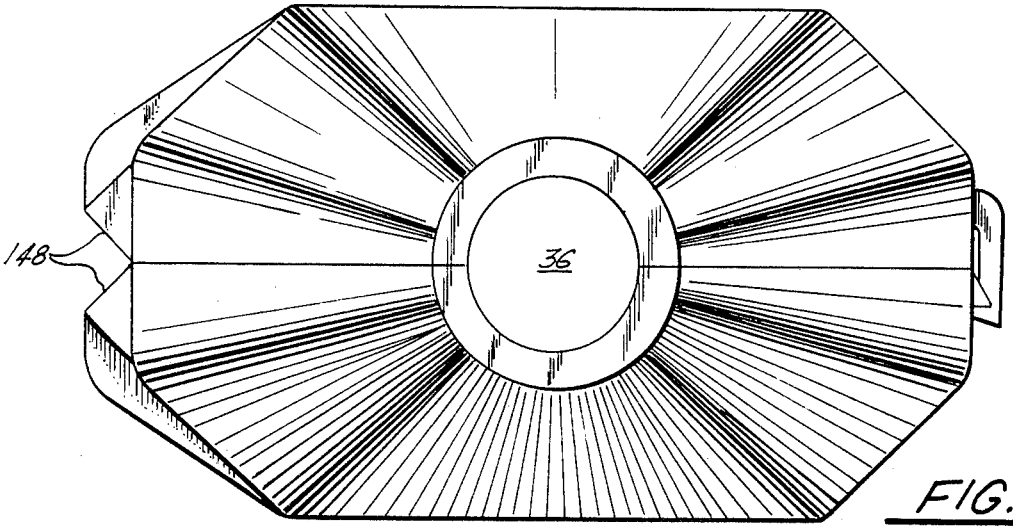
FIG. 6 is an enlarged, side view of the housing of FIG. 1 showing the tube dispensing aperture.
Figure 7:
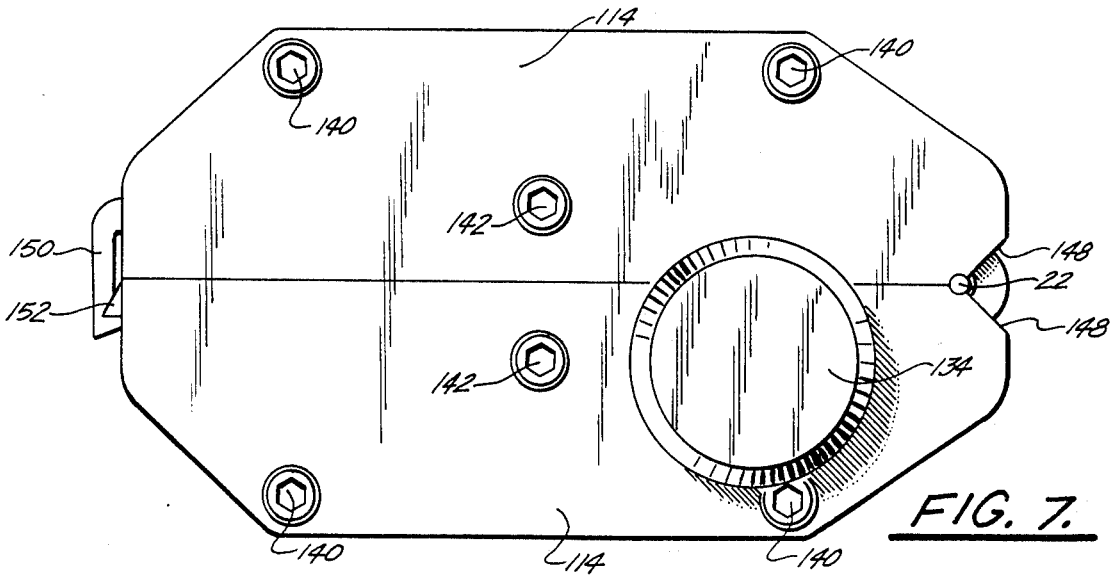
FIG. 7 is an enlarged, side view of the housing of FIG. 1 showing the bottom end of the housing at which the knob is located.

Housing 14 is provided with right angle inset 148 to provide a stop against the movement of shells 18, 20 around hinge 22, as shown in FIGS. 6 and 7.

Shell 18 is also provided with a pair of hooks 150 while shell 20 is provided with a latch 152 (see especially FIGS. 3, 5 & 7). In operation, hook 150 is pulled away from latch 152 so that shells 18, 20 can be disengaged from each other and rotated away from each other around hinge 22 to the position shown in phantom in FIG. 8. Tube 12 can then be placed within housing 14 so that the cap 154 of tube 12 protrudes outwardly through aperture 36 of housing 14. Shells 18, 20 are rotated around hinge 22 back towards each other so that hook 150 and latch 152 can be interconnected to secure shells 18, 20 to one another. Tube 14 is now positioned such that the first base 74 of first squeezer 70 and the first base 78 of second squeezer 72 are in squeezing engagement with the flatened seam base 154 of tube 114. Squeezers 70, 72 are transverse to tube 12 and bases 74, 78 are substantially perpendicular to the longitudinal axis of tube 12.

Knob 134 is rotated clockwise to impart a clockwise rotational motion to drive wheel 122 which in turn imparts a counterclockwise rotational motion to gear wheel 118. The counterclockwise motion of gear wheel 118 transmits a clockwise rotational motion to pinion 120 which in turn imparts a counterclockwise rotational motion to gear wheel 116. Sprocket wheels 106, 108 are rotated uniformly with gear wheels 116, 118 to which they are fixedly attached, and the counterclockwise motion of each of sprockets 106, 108 is transferred to sprocket wheels 110, 112 through belts 126, 130 as teeth 128, 132 positively engage sprocket wheels 106, 108, 110, 112. The movement of sprockets 110, 112 imparts a counterclockwise rotational motion to rods 44, 48 which is identical and at the same speed as the rotational motion of rods 46, 50. The right-hand threaded rods 44, 46, 48, 50 threadably engage the internal threads of nuts 58, 60, 62, 64 to advance the nuts at a uniform rate along rods 44, 46, 48, 50. As the nuts advance, they carry shafts 66, 68 at a uniform rate longitudinally through housing 14 toward aperture 36. The movement of shafts 66, 68 in turn longitudinally advances first bases 74, 78 of squeezers 70, 72 towards aperture 36, and also moves second bases 76, 80 towards aperture 36 at the same rate as first bases 74, 78 are being moved. Rollers 90, 92, 94 and 96 reduce frictional engagement between squeezers 70, 72 and grooves 98, 100, 102, 104 in which they are engaged.

As squeezers 70, 72 reach the position of most advanced longitudinal advancement, rollers 90, 92, 94, 96 reach a stop point 156 (FIG. 4) beyond which they can advance no further. Because of the flexible nature of squeezers 70, 72, as shafts 66, 68 continue to advance the squeezers 70, 72 will be deformed to change the profile of squeezers 70, 72 to that shown in phantom in FIG. 4. As the profile thus changes, the remaining material inside collapsible tube 12 is forced out of the tube so that a minimum amount of the contents is wasted.

Hook and latch 150, 152 can then be disengaged from each other, shells 18, 20 rotated away from each other around hinge 22, and collapsed tube 12 removed from housing 14. Knob 134 can then be rotated in a counterclockwise direction to retract squeezers 70, 72 to their original positions shown in FIG. 4 so that the dispenser 10 can be used again for a new tube.

What is claimed as invention is:

1. A dispenser for the contents of a collapsible tube, comprising:

an elongated housing having an internal cavity configured to receive a collapsible tube therewithin, said housing being provided with a dispensing aperture at a first end thereof;

a first pair of parallel, externally threaded rods rotatably mounted longitudinally within said housing;

a second pair of parallel, externally threaded rods rotatably mounted longitudinally within said housing in spaced, opposing, parallel relationship to said first pair of threaded rods;

a first flexible trapezoidally shaped squeezer mounted to said first pair of threaded rods and a second flexible trapezoidally shaped squeezer mounted to said second pair of threaded rods, said squeezers being configured to cooperatively squeeze the contents out of the collapsible tube as the squeezer's move from a first position to a second position, each squeezer having a first base which is positioned to be in contact with the tube in both the first and second positions, the squeezers also having a second base, each squeezer being provided with means for decreasing the distance between the first and second bases of each squeezer as the squeezer moves from the first position to the second position, the decreasing distance between the bases changing the profile of each squeezer to bring the squeezer into greater contact with the tube to be squeezed.

2. The dispenser of claim 1 wherein said means for advancing said squeezers is comprised of an internally threaded nut mounted in rotatable engagement on each of said first pair of threaded rods with a first driving shaft fixed therebetween, and an internally threaded nut mounted in rotatable engagement on each of said second pair of threaded rods with a second driving shaft fixed therebetween, said first flexible squeezer being mounted on said first driving shaft and said second squeezer being mounted on said second driving shaft, the externally threaded driving rods being rotated to advance the shafts and squeezers through said housing to squeeze the tube progressively longitudinally of the housing.

3. The dispenser of claim 2, wherein said housing is comprised of first and second opposing, complementary, substantially mirror image shells joined along a longitudinal hinge about which said shells may be rotated to selectively pivot said shells away from each other and open said casing, said first pair of threaded rods being mounted in said first shell and said second pair of rods being mounted in said second shell.

4. The dispenser of claim 3, wherein the internal cavity of each shell is generally trapezoidal in cross-section, the first parallel base of the trapezoid in each shell presenting an opening to cooperatively form the tube receiving cavity, the second parallel base of the trapezoid being closed to form a longitudinal wall of the shell, said first pair of threaded rods mounted adjacent and substantially parallel to the first base in said first shell and said second pair of threaded rods mounted adjacent and substantially parallel to the first base in said second shell.

5. The dispenser of claim 4, wherein each of said first and second generally trapezoidally shaped flexible squeezers has a first base and a second base substantially parallel thereto, the first base of said first squeezer being mounted on said first driving shaft, the first base of said second squeezer being mounted on said second driving shaft, the distance between said first bases of said squeezers being sufficient to provide a clearance through which only a substantially emptied tube may pass, the second base of each squeezer being configured to circumscribe a roller pin, a cylindrical roller being provided at each terminus of each roller pin, the rollers being in rolling engagement with the longitudinal wall having grooves to provide means for guiding longitudinal movement of the squeezers.

6. The dispenser of claim 5 further comprising a window slot longitudinally disposed along said casing through said longitudinal wall, and an indicator mark on the squeezer adjacent said window which can be viewed through said window and which moves as said squeezer is advanced to indicate the degree to which the contents of said tube have been dispensed.

7. The dispenser of claim 6, wherein said means for advancing said squeezers further comprises:

sprocket wheels affixed concentrically to each of said threaded rods adjacent the second end of said housing, all of said sprocket wheels being in substantially the same transverse plane through said housing;

a gear wheel concentrically mounted on one of each of said first and second pairs of threaded rods, said gear wheels being mounted on the threaded rods adjacent said longitudinal hinge;

a pinion wheel mounted concentrically on said longitudinal hinge and in mesh with both of said gear wheels for transmitting rotational movement from one gear wheel to the other;

a drive wheel rotatably mounted in said housing and in mesh with one of said gear wheels, said drive wheel being provided with a drive axle projecting through the second end of said casing;

a first synchronous continuous belt having internal teeth for positively engaging said sprocket wheels on each of said first pair of threaded rods;

a second synchronous continuous belt having internal teeth for positively engaging said sprocket wheels on each of said second pair of threaded rods;

a knob affixed to the projecting portion of said drive axle for turning said drive wheel to impart rotational motion in a first direction to said gear wheel with which it is in mesh, said rotational motion being transmitted to the other of said gear wheels through said pinion wheel, both of said gear wheels thereby rotating in the same direction, the rotational motion of said gear wheels being transmitted through the rotation of the threaded rods to the sprocket wheels on said rods adjacent said hinge, the rotational movement of said sprocket wheels adjacent the hinge being transmitted to the sprocket wheels not adjacent the hinge through said first and second synchronous belts, the movement of the sprocket wheels not adjacent the hinge being imparted to the threaded rods to which they are affixed, the resulting uniform rotational movement of said first and second pairs of threaded rods longitudinally moving said nuts along said rods to advance and retract said squeezers.

8. A dispenser for the contents of a collapsible tube, comprising:

an elongated housing having an internal cavity configured to receive a collapsible tube therewithin, said housing being comprised of first and second opposing, complementary, substantially mirror image shells joined along a longitudinal hinge about which said shells may be rotated to selectively pivot said shells away from each other and open said housing, the internal cavity of each shell being generally trapezoidal in cross-section, the first parallel base of the trapezoid in each shell presenting an opening to cooperatively form the tube receiving cavity, the second parallel base of the trapezoid being closed to form a longitudinal wall of the shell, said housing being provided with a dispensing aperture at a first end thereof;

a first pair of parallel, externally threaded rods rotatably mounted longitudinally within said first shell adjacent the first base of said cavity in said first shell, an imaginary plane through said first pair of rods being substantially parallel to the parallel bases of said trapezoidal shell;

a second pair of parallel, externally threaded rods rotatably mounted longitudinally within said second shell adjacent the first base of said cavity in said second shell and in spaced, opposing parallel relationship to said first pair of threaded rods, an imaginary plane through said second pair of rods being substantially parallel to the imaginary plane through said first pair of rods;

an internally threaded nut mounted in rotatable engagement on each of said first pair of threaded rods with a first driving shaft fixed therebetween, and an internally threaded nut mounted in rotatable engagement on each of said second pair of threaded rods with a second driving shaft fixed therebetween;

first and second generally trapezoidally shaped flexible squeezers each having a first base and a second base substantially parallel thereto, each squeezer being adapted to change its configuration as it is advanced towards the top of the tube, to achieve a greater area of contact with the top portion of the tube, the first base of said first squeezer being mounted on said first driving shaft, the first base of said second squeezer being mounted on said second driving shaft, the distance between said first bases of said squeezers being sufficient to provide a clearance through which only a substantially emptied tube may pass, the second bases of said squeezers being longitudinally displaced in said housing towards said dispensing aperture the second base of each squeezer being configured to circumscribe a roller pin, a cylindrical roller being provided at each terminus of each roller pin, the rollers being in rolling engagement with the longitudinal wall which is provided with opposing, substantially parallel and at least partially roller enclosing grooves longitudinally disposed within the longitudinal wall, said grooves providing means for guiding longitudinal movement of the squeezers, means in said grooves for changing the distance between the first and second bases of each squeezer as the squeezer moves from a first position to a second position, the decreasing distance between the bases changing the profile of each squeezer to bring the squeezer into greater contact with the tube to be squeezed;

sprocket wheels affixed concentrically around each of said threaded rods adjacent the second end of said housing, all of said sprocket wheels being in substantially the same transverse plane through said housing;

a gear wheel concentrically mounted on one of each of said first and second pairs of threaded rods, said gear wheels being mounted on the threaded rods adjacent said longitudinal hinge;

a pinion wheel mounted concentrically on said longitudinal hinge and in mesh with both of said gear wheels for transmitting rotational movement from one gear wheel to the other;

a drive wheel rotatably mounted in mesh with one of said gear wheels, said drive wheel being provided with a drive axle projecting through the second end of said housing;

a first synchronous continuous belt having internal teeth for positively engaging said sprocket wheels on each of said first pair of threaded rods;

a second synchronous continuous belt having internal teeth for positively engaging said sprocket wheels on each of said second pair of threaded rods;

a knob affixed to the projecting portion of said drive axle for turning said drive wheel to impart rotational motion in a first direction to said gear wheel with which it is in mesh, said rotational motion being transmitted to the other of said gear wheels through said pinion wheel, both of said gear wheels thereby rotating in the same direction, the rotational motion of said gear wheels being transmitted through the rotation of the threaded rods to the sprocket wheel on said rods adjacent said hinge, the rotational movement of said sprocket wheels adjacent the hinge being transmitted to the sprocket wheels not adjacent the hinge through said first and second synchronous belts, the movement of the sprocket wheels not adjacent the hinge being imparted to the threaded rods to which they are affixed, the resulting uniform rotational movement of said first and second pairs of threaded rods longitudinally moving said nuts along said rods to advance and retract said squeezers;

a window slot longitudinally disposed along said housing through one of said longitudinal walls, and an indicator mark on the squeezer adjacent said window which can be viewed through said window and which moves as said squeezer is advanced to indicate the degree to which the contents of said tube have been dispensed.

9. A dispenser for the contents of a collapsible tube, comprising:

an elongated housing having an internal cavity configured to receive a collapsible tube therewithin, said housing being provided with a dispensing aperture at a first end thereof; and first and second flexible squeezers mounted in opposing relationship within the housing and being provided with means for moving the squeezers in opposed relationship longitudinally within the elongated housing, the squeezers being mounted within the housing so that they deform adjacent the dispensing aperture to achieve greater contact with the tube and substantially empty the tube as the squeezer's move from a first position to a second position, each squeezer having a first base which is positioned to be in contact with the tube in both the first and second positions, the squeezers also having a second base, each squeezer being provided with means for decreasing the distance between the first and second bases of each squeezer as the squeezer moves from the first position to the second position, the decreasing distance between the bases changing the profile of each squeezer to bring the squeezer into greater contact with the tube to be squeezed.

10. The dispenser of claim 9 wherein each of the squeezers is trapezoidally shaped.

* * * * *